US005097680A

United States Patent [19]

Lin

[11] Patent Number: 5,097,680

[45] Date of Patent: Mar. 24, 1992

[54] STRUCTURE OF A CONVERTIBLE BRACELET

[75] Inventor: Hong-Ta Lin, Kaohsung, Taiwan

[73] Assignee: Hsiang HWA Industrial Co., Ltd., Tainan, Taiwan

[21] Appl. No.: 690,642

[22] Filed: Apr. 24, 1991

[51] Int. Cl.[5] ..... A44C 5/00

[52] U.S. Cl. ..... 63/3; 63/15.7; 63/2

[58] Field of Search ..... 63/1.1, 2, 3, 6, 9, 63/15, 15.7, 29.1; 40/633

[56] References Cited

U.S. PATENT DOCUMENTS

| | | | |
|---|---|---|---|
| 31,735 | 3/1861 | Palmer | 63/3 X |
| 352,917 | 11/1886 | Granbery | 63/3 X |
| 1,778,726 | 10/1930 | Pappert | 63/2 X |
| 1,936,604 | 11/1933 | Moldenhauer | 63/15 |
| 3,790,775 | 2/1974 | Rosenblatt | 63/1.1 X |
| 4,817,064 | 3/1989 | Milles | 63/1.1 X |

FOREIGN PATENT DOCUMENTS

| | | | |
|---|---|---|---|
| 51663 | 5/1936 | Denmark | 63/1.1 |
| 321629 | 12/1987 | European Pat. Off. | 63/3 |
| 824527 | 2/1938 | France | 63/3 |
| 12033 | of 1885 | United Kingdom | 63/3 |
| 8911809 | 12/1989 | World Int. Prop. O. | 63/15.7 |

*Primary Examiner*—Renee S. Luebke
*Assistant Examiner*—Jerry Redman
*Attorney, Agent, or Firm*—Morton J. Rosenberg; David I. Klein

[57] ABSTRACT

A structure of a convertible bracelet is provided having an annular shape and comprising a plurality of cylindrical rim members and binding members. The cylindrical rim on the surface of the rim can be rotated axially, and by means of such rotational movement, different combinations of colors and patterns are thus obtained. The rim axle is formed from a top and bottom rim axle, each having a plurality of holes formed therein for coupling with the binding members. Each of the cylindrical rim members are formed from a plurality of curved pieces rotatably captured between a pair of binding members.

3 Claims, 6 Drawing Sheets

STRUCTURE OF A CONVERTIBLE BRACELET

BACKGROUND OF THE INVENTION

The present invention relates to a structure of a convertible bracelet having an annular shape. The top and bottom rim axles can be translated in a horizontal direction, one with respect to the other. The cylindrical rims on the rim axle can be rotated axially about the rim axle, and by means of the rotational movement, different colors and patterns of the combination of elements of the bracelet are thus obtained.

Convertible structures in toys are available in market, however, the magic cube which provides for various combinations of colors has greatly attracted both the children and the adults for a number of years. The present convertible bracelet provides a great resource in forming color patterns and/or combinations for those who wear the bracelet.

SUMMARY OF THE INVENTION

Accordingly, it is an object of the present invention to provide a structure of a convertible bracelet in which the top and bottom axles of the bracelet can be translated in a horizontal direction. The cylindrical rim fixed on the rim axle can be rotated axially about the rim axle, and by means of the rotational movement, different colored patterns and patterns of combinations are thus obtained.

It is another object of the present invention to provide a structure of a convertible bracelet, wherein the appearance of the bracelet provides the wearer a sense of beauty.

It is yet another object of the present invention to provide a structure of a convertible bracelet of which the colors and patterns can be changed by the rotation of the cylindrical rim.

BRIEF DESCRIPTION OF THE DRAWINGS

The present invention will be further explained with reference to the annexed drawings, wherein.

DETAILED DESCRIPTION OF THE INVENTION

While this Specification concludes with claims particularly pointing out and distinctly claiming that which is considered to be the invention, it is believed that the invention can be better understood from a reading of the following detailed description of the invention.

Figure 1:
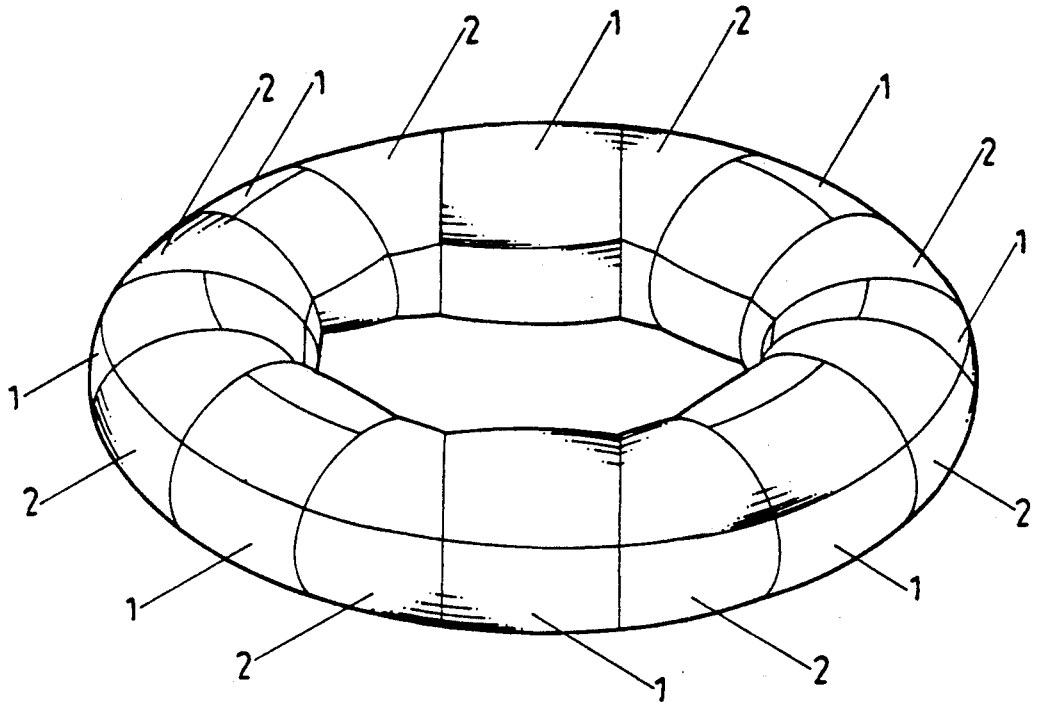
FIG. 1 is a perspective view of a structure of a convertible bracelet in accordance with the present invention.
Figure 2:
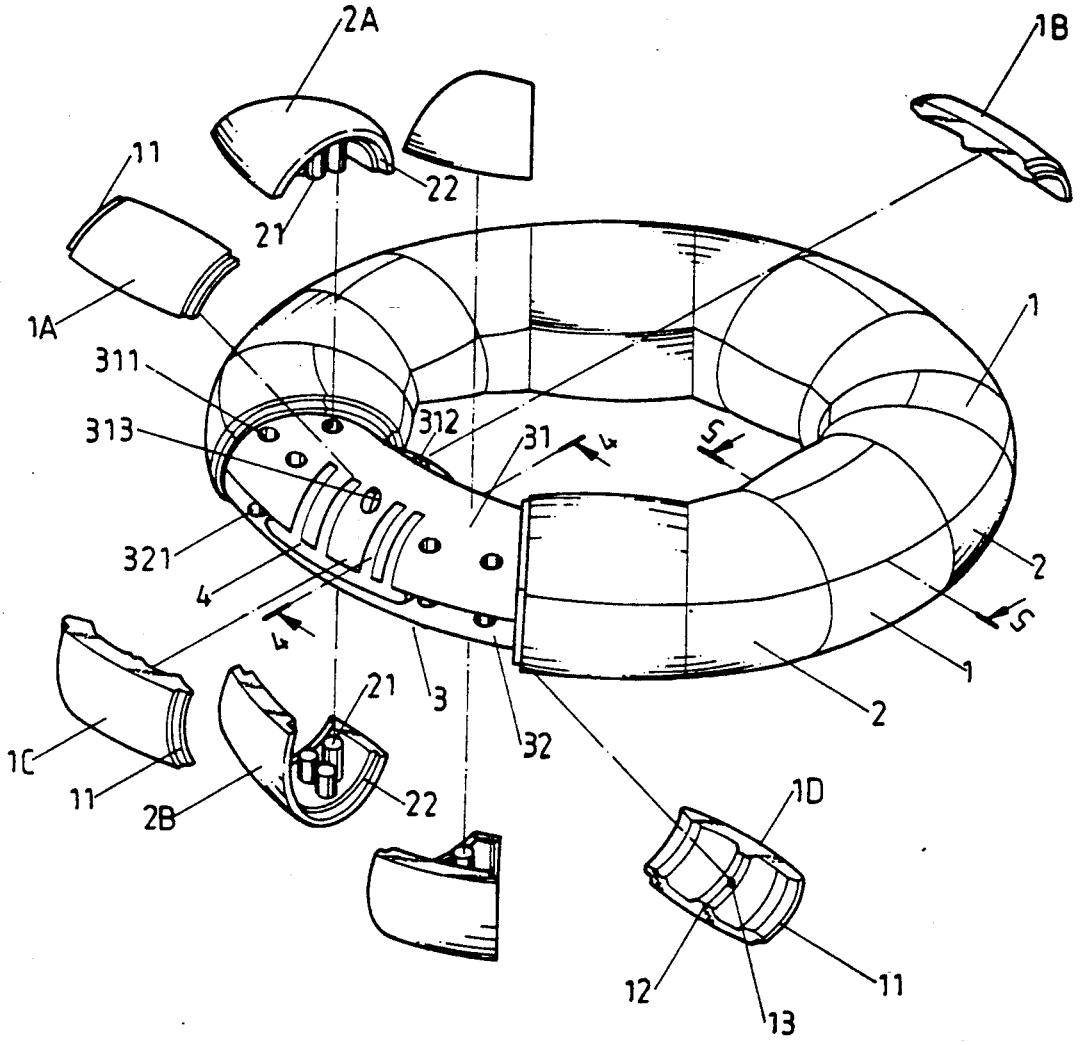
FIG. 2 is a partial exploded perspective view, showing the plurality of cylindrical rims and binding members of a structure of a convertible bracelet in accordance with the present invention.

Referring to the figures, in particular, FIGS. 1 and 2, a convertible bracelet is shown. In accordance with the present invention, the bracelet is substantially an annular shape, wherein a plurality of cylindrical rims 1 and binding members 2 arranged alternately are formed on the surface thereof. As shown in FIG. 2, cylindrical rim 1 and binding member 2 are mounted along the external surface of a circular axle 3. The axle 3 is formed from a top and a bottom rim axle member 31, 32, respectively. A plurality of insertion holes 311, 321 are provided respectively on the arch-shaped upper surface and bottom surface of the top and bottom rim axle members 31, 32. These holes 311, 321 are provided for insertion of the binding member 2.

The binding member 2 is formed from semi-cylindrical pieces 2A, 2B. The respective arch-shaped interior surfaces thereof being provided with three protrusions 21 formed in a triangular pattern. This allows respective insertion into the insertion hole 311 of the top and bottom rim axle members 31, 32. The interior face of the two opposing arcuate edges of each binding member 2 is formed with step-like arcuate recess 22 for the insertion of the cylindrical rim 1.

Figure 3:
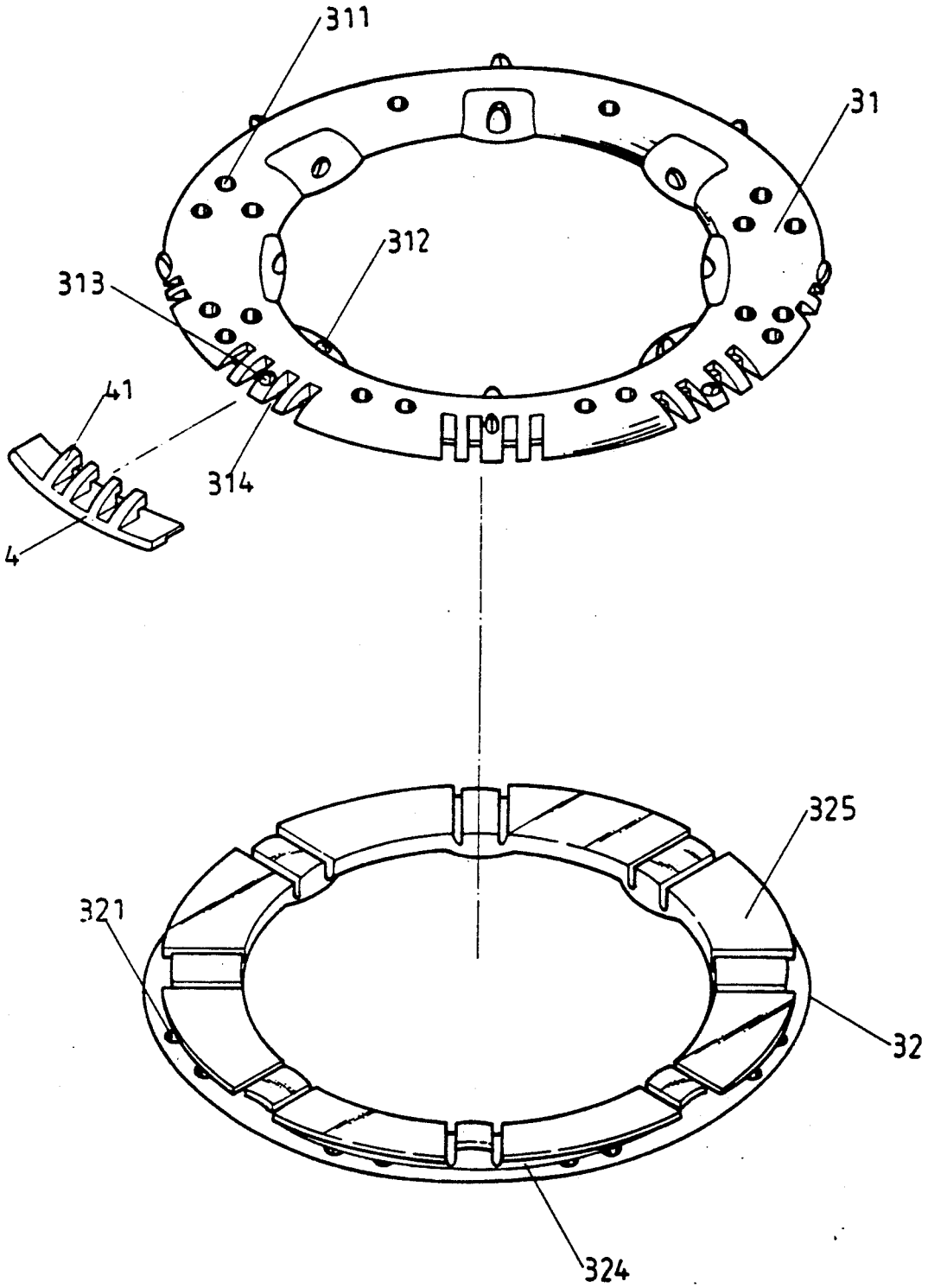
FIG. 3 is an exploded perspective view showing the center axles of the structure of a convertible bracelet in accordance with the present invention.

The cylindrical rim 1 is formed from four pieces of arch-shaped actuatable units 1A, 1B, 1C, and 1D. The opposing arch-shaped edges of the cylindrical rim 1 are each extended outward to form respective protrusions 11 for the insertion into respective arcuate recesses 22 of respective binding members 2, such that the cylindrical rim 1 can be rotated with respect to the axle while being engaged by the edge of the binding member 2. The middle section of the actuatable units 1A, 1B, 1C, and 1D is provided with a long arch-shaped guiding rail 12 with a depression 13 formed therein. In combination with respective protrusions 313, 314 of the top and bottom rim axle members 31, 32, the rim 1 can only be rotated to a specific position of the center axle 3. By means of the detent formed by the protrusions 312, 322, 313, 323, and respective depressions 13, the cylindrical rim 1 can be rotated and stopped at predetermined positions. FIG. 3 is a further detail of the center axle 3. The center axle 3 is formed from the upper rim axle member 31 and the lower rim axle member 32. In addition to the insertion holes 311, 321, and protrusions 312, 322, 313, and 323, a plurality of engaging slots 314 are provided on the uppper rim axle member 31 in spaced groupings of multiple engaging slots. Each engaging slot 314 of a particular grouping can be engaged by a respective finger member 41 provided on the upper end of an insertion plate 4. The bottom section of the insertion plate 4 is mounted for extension into the slot 324 of the rim axle member 32, such that the top and bottom rim axle members 31, 32 can be rotated horizontally, one with respect to the other, subsequent to engagement of a respective plate 4 with each grouping of slots 314 formed in top rim axle member 31. During horizontal rotation, the insertion plate 4 is driven by means of the slots 314 by which the insertion plate 4 is engaged with the top rim axle member 31. The bottom section of the insertion plate 4 slides within the slot 324 of the bottom rim axle member 32.

Figure 4:
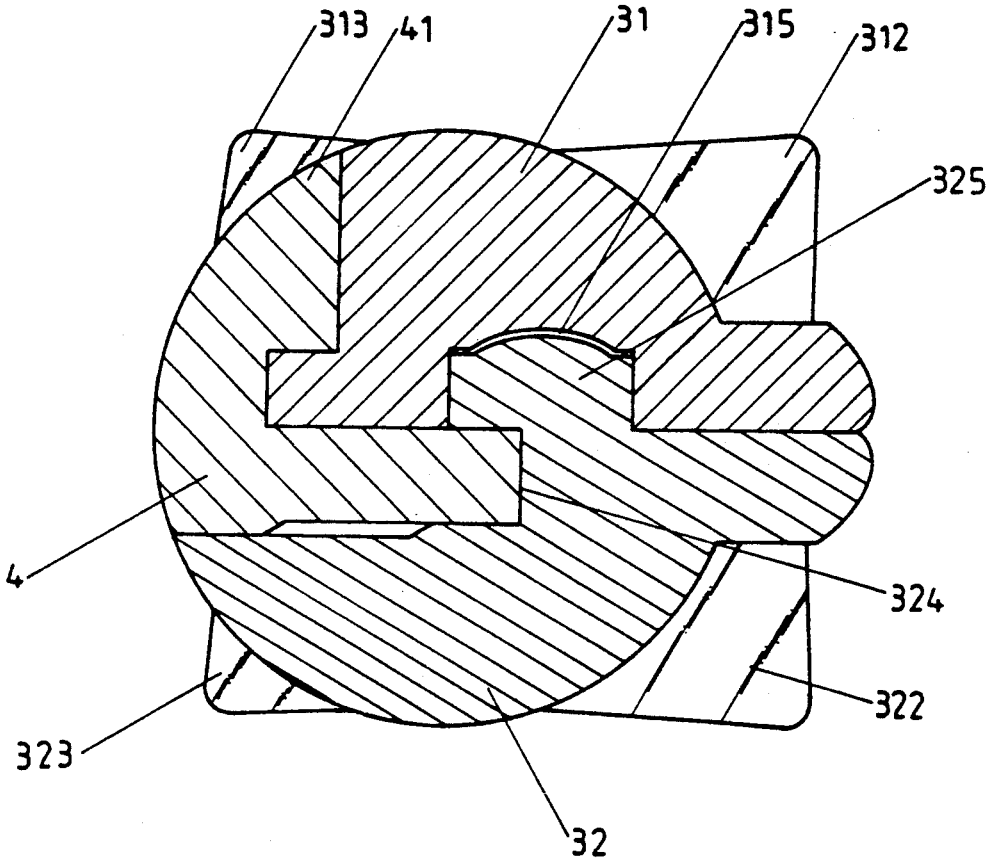
FIG. 4 is a sectional view along the section line 4—4 of FIG. 2.

Referring to FIG. 4, it is indicated that a groove or path 315 is provided at the center of the bottom surface of top rim axle member 31. The path 315 can be engaged with the protruded edge 325 of the bottom rim axle member 32. As can be seen clearly in FIG. 4, the finger member 41 is engaged with the top rim axle member 31 and the bottom of the insertion plate 4 is inserted into slot 324 formed in the bottom rim axle member 32.

Thus, the top and bottom rim axle members 31, 32 can be rotated in a horizontal direction without separating.

Figure 5:
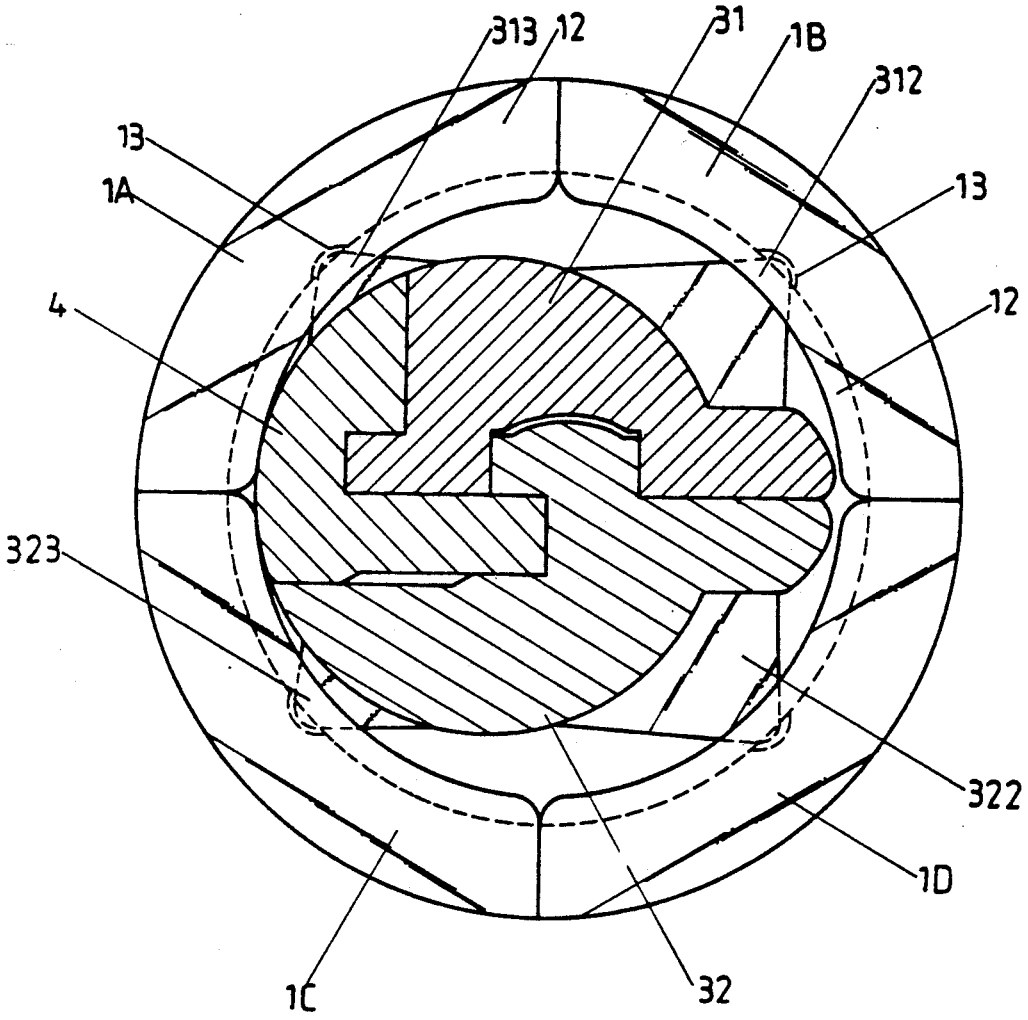
FIG. 5 is a sectional view along the section line 5—5 of FIG. 2.

Referring to FIG. 5, it is shown that the protrusions 312, 322, 313 and 323 are combined with the guiding rail 12 of the respective actuatable units 1B, 1D, 1A, 1C of cylindrical rim 1, for rotation about circular axle 3. As shown in FIB. 5, when the protrusions 321, 322, 323 and 313 are respectively engaged with the small depressions 13 of rim 1, a predetermined position of the rim is established.

Figure 6:
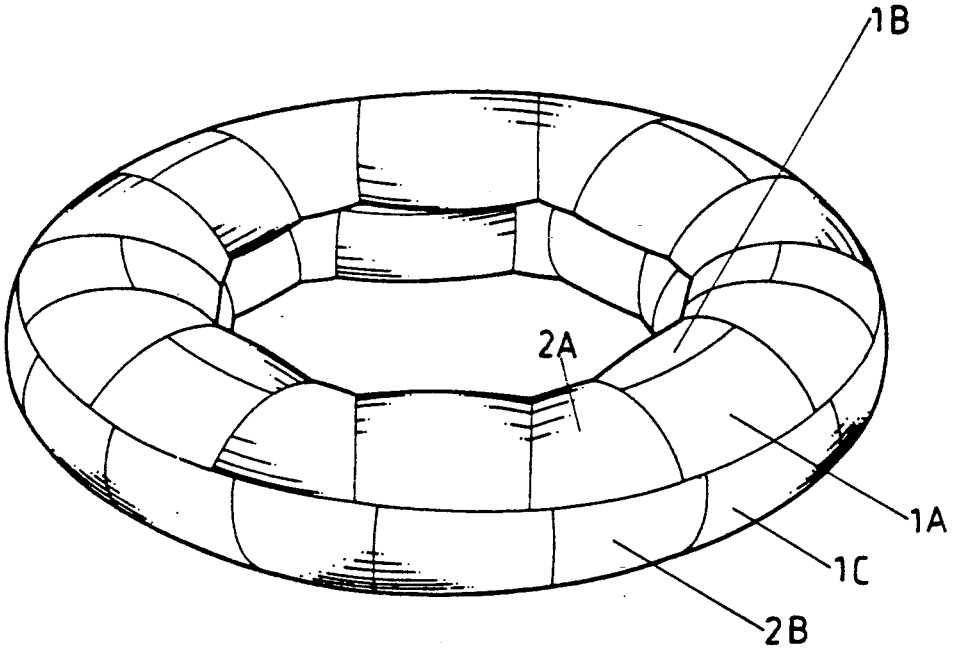
FIG. 6 is a perspective view of the structure of a convertible bracelet in accordance with the present invention.

Referring to FIG. 6, the actuatable units 1A, 1B, and 1C, 1D of the cylindrical rim 1 are shown horizontally displaced so as not to be rotatable about circular axle 3. After the top and bottom rim axle members 31, 32 are rotated to a standard position, a position is thus obtained wherein the cylindrical rim is rotatable. In order to horizontally rotate the top and bottom rim axle members 31, 32, the cylindrical rim 1 should be rotated to the standard detent position. At the standard position, the actuatable units 1A, 1B and 1C, 1D are at an aligned horizontal position, and the horizontal rotation of the top and bottom rim axle members 31, 32 will displace the respective actuatable units. Thus, a new combination will form with adjacent actuatable units.

As stated above, the four actuatable units of the cylindrical rim 1 can be changed by means of rotation thereof along with the top rim axle member 31 with respect to the bottom rim axle member 32 of the circular axle 3. Thus, with the above features, the cylindrical rim 1 can be designed with numbers, colors, or designed with patterns, and by means of the rotation of the cylindrical rims 1 and the top and bottom rim axle members 31, 32, various combinations of the numbers, colors or patterns are thus obtained.

While only one embodiment of the present invention has been shown and described herein, it will be appreciated that modifications thereof may be readily made thereto by those skilled in the art. Therefore, it is intended by the appended claims to cover the modifications alluded to herein as well as all other modifications which fall within the true spirit and scope of our invention.

I claim:

1. A convertible bracelet structure, comprising;

(a) an annularly shaped axle formed by a top rim axle member rotatively coupled to a bottom rim axle member for rotation of one with respect to the other;

(b) a plurality of cylindrical rims disposed in angularly spaced relation on said annularly shaped axle, each of said cylindrical rims being rotatively coupled to said annularly shaped axle, each of said cylindrical rims including four arch shaped members, each of said arch shaped members having (1) a pair of opposing ends and being disposed in end to end relation to form an annulus about said annularly shaped axle, and (2) an opposing pair of protruding edges; and, (c) a plurality of binding members disposed in angularly spaced relation on said annularly shaped axle, each of said binding members being interposed between respective spaced pairs of said cylindrical rims, each of said binding members including a pair of semi-cylindrically shaped members coupled to said annularly shaped axle, each of said semi-cylindrically shaped members having a plurality of protrusions extending from an interior surface thereof for coupling to said annularly shaped axle, one of each of said pairs of said semi-cylindrically shaped members being coupled to said top rim axle member and the other of each of said pairs of said semi-cylindrically shaped members being coupled to said bottom rim axle member, each of said semi-cylindrically shaped members having an opposing pair of recessed edges for receiving said protruding edges of respective arch shaped members disposed on opposing sides thereof.

2. The convertible bracelet structure as recited in claim 1 where said top rim axle member includes a bottom surface having a groove formed therein for receiving a protrusion extending from said bottom rim axle member.

3. The convertible bracelet structure as recited in claim 1 where each of said arch shaped members of said cylindrical rims are colored differently.

* * * * *